United States Patent [19]

Wolff

[11] 4,278,535

[45] Jul. 14, 1981

[54] SCREEN DECKS

[75] Inventor: Kurt Wolff, Dinslaken, Fed. Rep. of Germany

[73] Assignee: Firma Steinhaus GmbH, Mülheim an der Ruhr, Fed. Rep. of Germany

[21] Appl. No.: 48,639

[22] Filed: Jun. 14, 1979

[30] Foreign Application Priority Data

Jul. 26, 1978 [DE] Fed. Rep. of Germany ..... 2832747

[51] Int. Cl.[3] ..... B07B 1/46

[52] U.S. Cl. ..... 209/399; 209/414

[58] Field of Search ..... 209/397–399, 209/405, 408, 392, 393, 395, 412, 414

[56] References Cited

U.S. PATENT DOCUMENTS

| | | | |
|---|---|---|---|
| 3,045,824 | 7/1962 | Parks | 209/414 X |
| 3,980,555 | 9/1976 | Freissle | 209/408 |
| 4,062,769 | 12/1977 | Simonson | 209/399 |
| 4,141,821 | 2/1979 | Wolff | 209/405 |

FOREIGN PATENT DOCUMENTS

| | | | |
|---|---|---|---|
| 1965005 | 7/1970 | Fed. Rep. of Germany | 209/399 |
| 2736662 | 2/1979 | Fed. Rep. of Germany | 209/395 |

*Primary Examiner*—Ralph J. Hill

*Attorney, Agent, or Firm*—Charles E. Baxley

[57] ABSTRACT

Several illustrative embodiments of this invention are shown and described. The screen deck for screening machines is assembled from rectangular screen members, preferably formed from a suitable synthetic material. These screen members abut one another directly to form a continuous screen surface. The screen members have at the edges of their undersides projections which complement one another in pairs along the abutting surfaces on only the longitudinal edges of the members. Longitudinally oriented support struts underneath the screens have aligned holes which engage the projections and thereby sustain the entire screening surface.

2 Claims, 18 Drawing Figures

SCREEN DECKS

This invention relates to screen decks for use in screening machines and more particularly to screen decks with rigid support struts and flexible screen members and the like arranged thereon.

Screen decks of this type are known from German Offenlegungsschriften Nos. 26 22 709 and 27 49 489. In these cases the support struts form a lattice with longitudinal and transverse struts for the screen members, which struts support the square or rectangular screen members along all of their edges. Correspondingly, the screen members have projections along the undersides of their longitudinal and transverse edges which engage the holes which are present in both the longitudinal and transverse struts of the support lattice.

This structure has certain disadvantages. For example, the longitudinal and transverse struts complicate the support lattice; such a support frame must therefore be specially adapted to the particular screening machine and must be assembled in a particular manner before it reaches its place of use. As a result of the use of longitudinal and transverse struts the support structure is not only heavy but also is correspondingly expensive. Another disadvantage is found in the transverse struts of the support lattice which are additional working parts that are subject to the abrasive action of the screened material passing through the screen surface. As a result of the oscillating movement of the screen deck, the screened material generally has a velocity component in the direction of feed when it passes through the screen openings. It is precisely the transverse struts of the support frame, which are in a transverse position with respect to the direction of feed, that are particularly affected by this screened material. Further as a result of having a lattice construction as the supporting framework, the effective screen surface of the entire screen deck is also reduced because the zones above the transverse struts naturally cannot be used as an open screen surface.

Screen decks also are known in which the support structure consists only of parallel supports. Flexible, positive-locking members into which screen panels have been inserted are placed on these supports in the direction in which the parallel supports are oriented (CH-PS No. 370 944). A substructure of this type however, is suitable only for screen members of rigid material, such as screen panels that are made of a hard ceramic or sintered metal material. A support structure of this type is not suitable for flexible screen members made of modern synthetic materials. In addition, the screen panels do not form a continuous screen surface in this case because the parallel supports stand out on the upper side of the screen and must be protected by means of coverings against the wearing effect of the screened material.

The object of the invention is therefore to improve a screen deck of the type mentioned initially by simplifying the construction of the substructure and thus also of the screen members so that the screen deck as a whole is lighter, has a greater effective screen surface and is less susceptible to wear.

These objects largely are attained in that the support struts in accordance with the invention are parallel longitudinal struts which are oriented in the direction of feed. The distance between adjacent pairs of these longitudinal struts being equal to the transverse edge length of the respective screen member placed upon them. Further in this regard, the length of the screen members in the direction of feed is equal and/or greater than the transverse screen member edge length. The screen members moreover, have projections on the undersides of their longitudinal edges only to engage the support struts.

A particular advantage of a screen deck according to the invention is that the support structure may optionally be assembled at the particular place of use using prefabricated individual supports. In this circumstances it is only necessary to screw, weld or otherwise connect these longitudinal struts to the transverse supports (transverse members) of the screening machines.

The omission of the transverse struts simplifies to a considerable extent the support structure directly supporting the screen members. The design of the screen members is also far less complicated. The screen members have projections on the undersides of their longitudinal edges only and there is practically no limitation on screen member length consequently, the effective screen surface is enlarged because with the transverse struts removed there are no dead zones on the screen. The increased effective screen surface permits either a greater throughput capacity or smaller dimensions for the screening area. The lack of transverse support has no adverse effect on the screening machine's oscillatory action and the strength of the screen members freely spanning the longitudinal struts of the support structure.

The Screen members of flexible material and in particular, synthetic material, can, if necessary, be sufficiently stiffened by embedded reinforcements, made for example of steel.

The other advantages of the invention can be seen in the subclaims and in the following description.

The invention will be described below with reference to the drawings by way of examples of arrangement, although the scope of the invention is limited only by the claims.

FIG. 1 is a plan view of a screen deck according to the invention;

FIG. 1*a* is a side view of the screen deck according to FIG. 1;

Figure 3B:
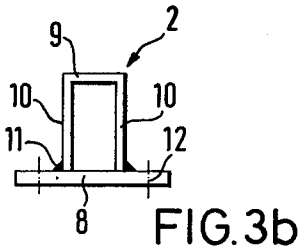
FIG. 3 is a plan view of one of the longitudinal support struts of the substructure of one of the screen decks according to FIG. 1 or 2.
Figure 3A:
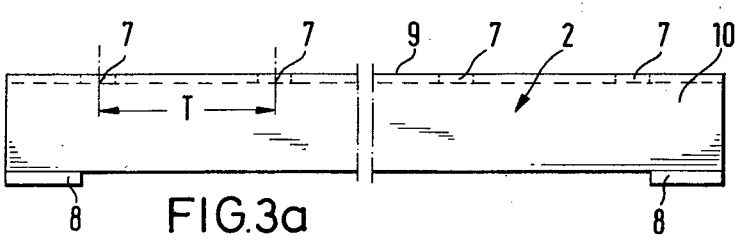
Figure 3:
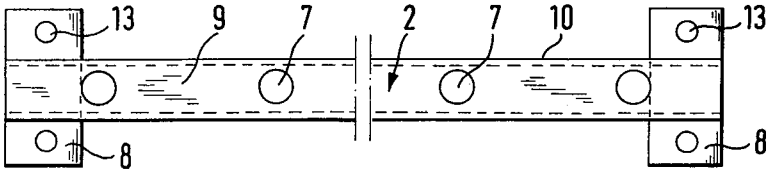
Figure 4A:
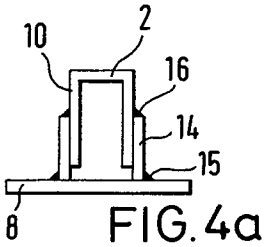
Figure 4:
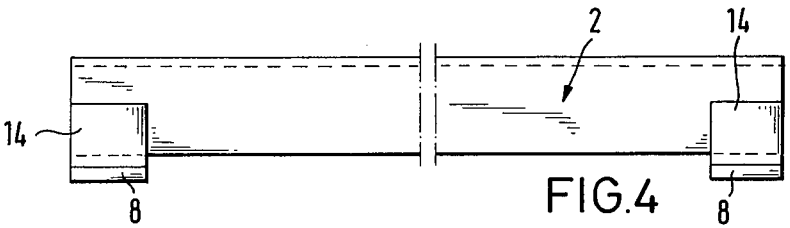
Figures 5, 5A, 5B, 6, 6B, 7, 7A, 8:
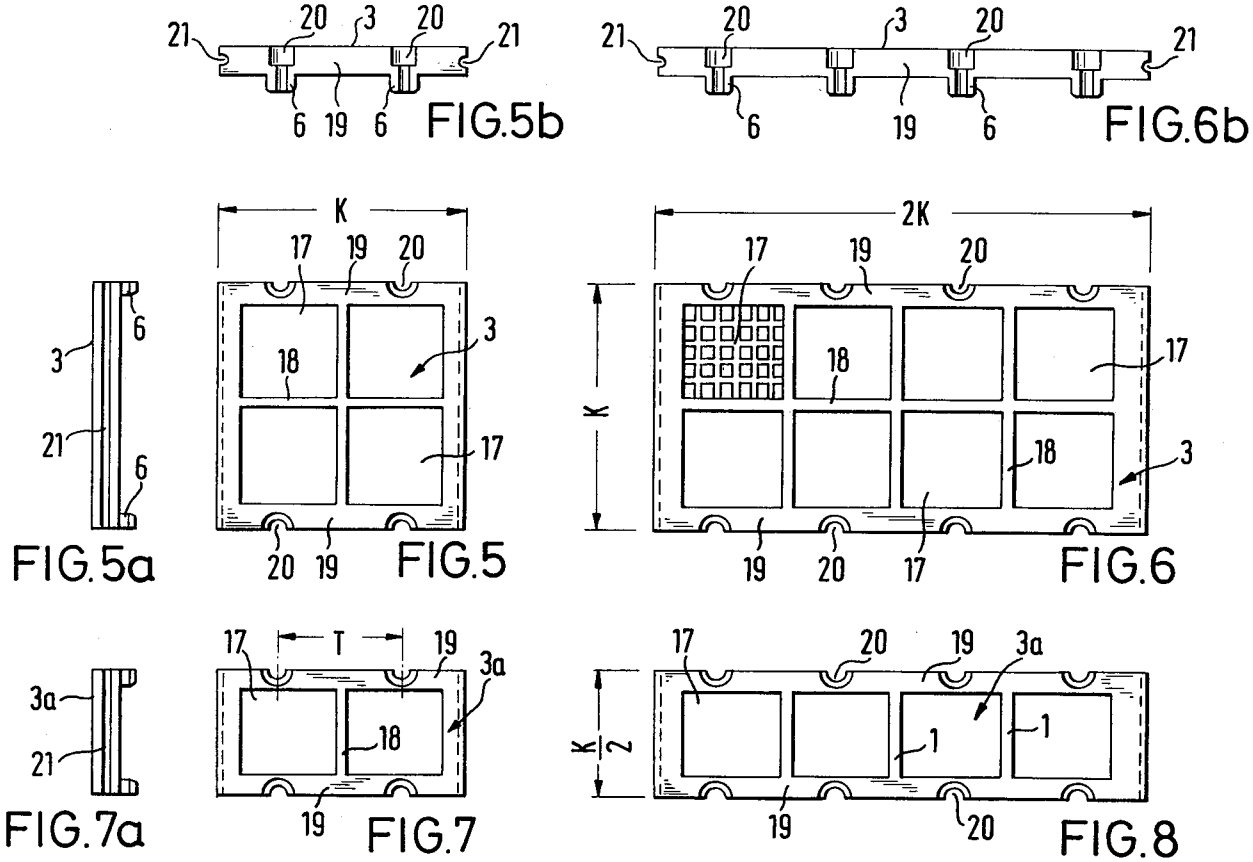
Figure 9:
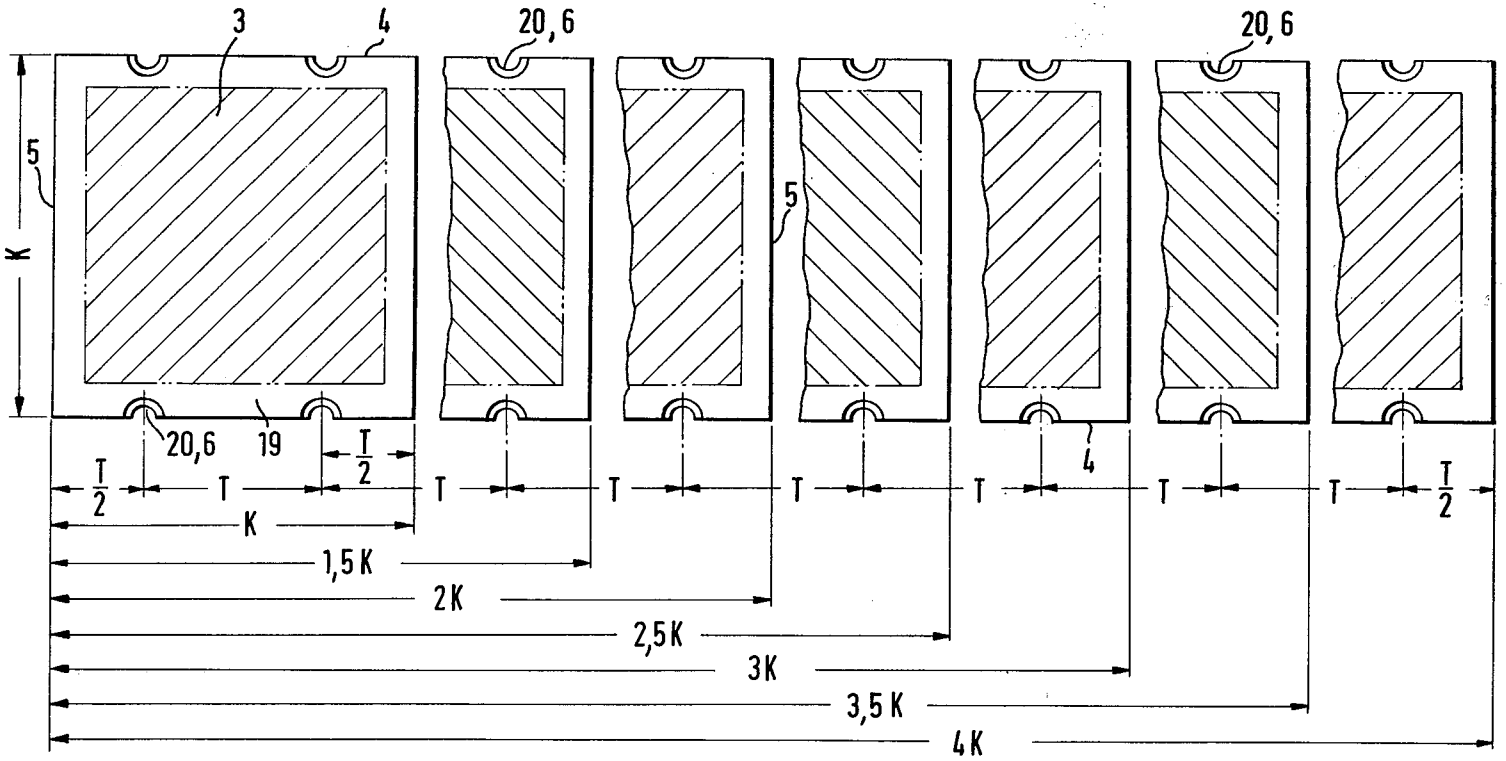
Figure 10:
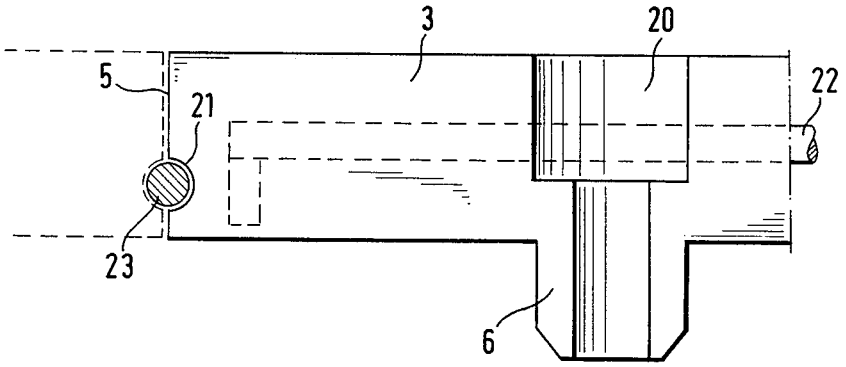

FIG. 3*a* is a side view of the longitudinal support struts according to FIG. 3;

FIG. 3*b* is a front view of the longitudinal support strut according to FIG. 3;

FIG. 4 is a side view of a further embodiment of a longitudinal support strut for a screen deck according to the invention;

FIG. 4*a* is a front view of the longitudinal support strut according to FIG. 4;

FIG. 5 is a plan view of a square screen member for a screen deck according to the invention;

FIG. 5*a* is a front view of the screen member according to FIG. 5;

FIG. 5*b* is a side view of the screen member according to FIG. 5;

FIG. 6 is a plan view of a rectangular screen member, having double the edge length in the direction of feed, for a screen deck according to the invention;

FIG. 6*b* is a side view of the screen member according to FIG. 6;

FIG. 7 is a plan view of a compensating screen member having half the edge length transverse to the direction of feed, for a screen deck according to the invention;

FIG. 7*a* is a front view of the screen member according to FIG. 7;

FIG. 8 is a plan view of a compensating screen member having half the edge length in the transverse direction but having double the edge length in the direction of feed;

FIG. 9 is a plan view of a screen member construction unit for a screen deck according to the invention; and FIG. 10 is a partial side view of a screen member for a screen deck according to the invention.

Figures 1, 1A:
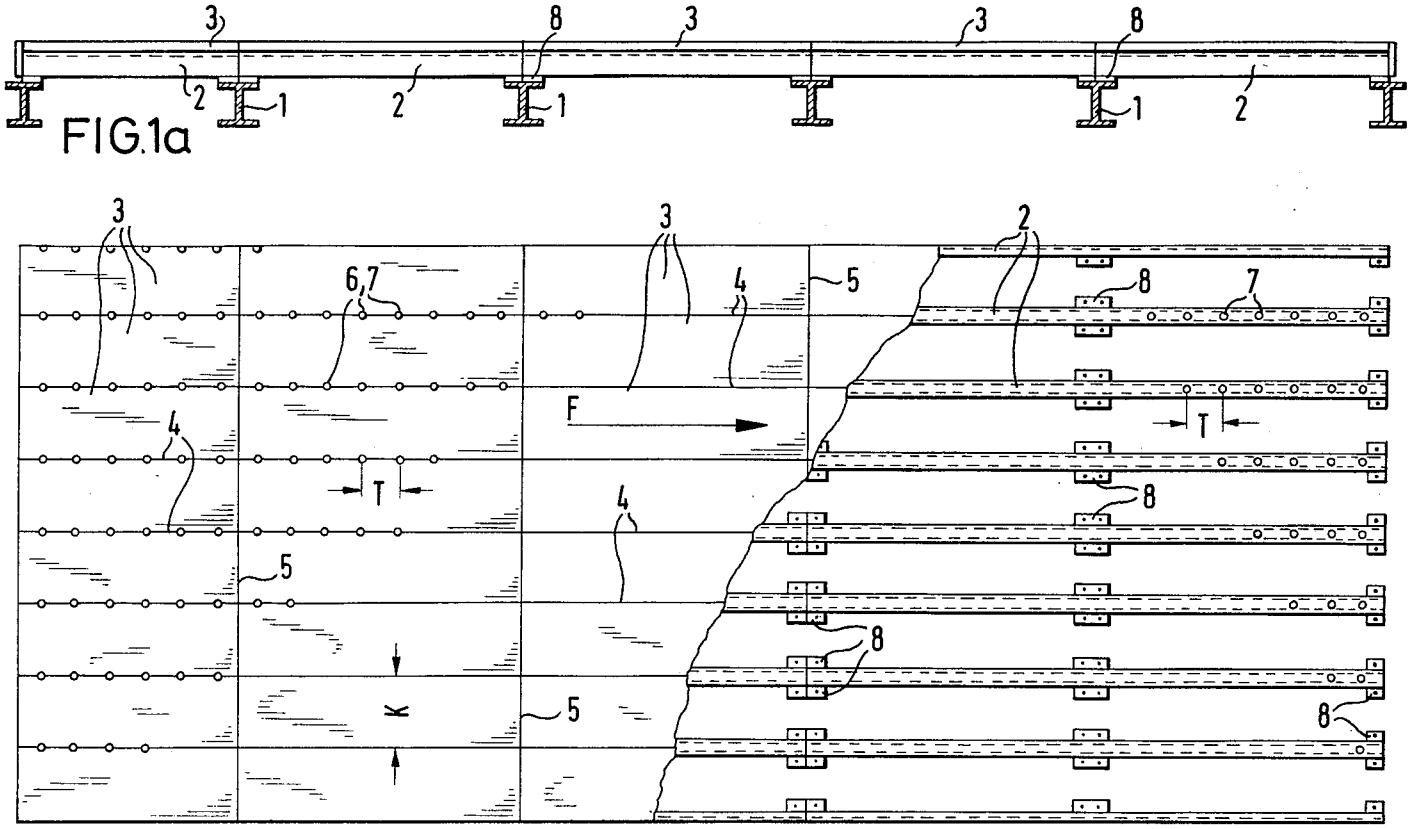

FIGS. 1 and 1*a* show the basic structure of a screen deck according to the invention. The screen deck is constructed on transverse members 1 which are a part of a screening machine or screening device, the balance of which is not shown in the drawing. The transverse members are thus not members of the support structure for the direct support of the screen deck.

The support structure is formed, rather, by longitudinal support struts 2 running parallel with one another in the direction of feed F.

On the longitudinal support struts 2 are arranged screen members 3 that form a continuous screen surface and abut one another directly at their longitudinal edges 4 and transverse edges or end faces 5. The longitudinal support struts 2 thus do not stand out on the upper side of the screen deck. The longitudinal support struts 2, as the substructure of the screen deck, are preferably prefabricated in factories and fitted in the particular screening machine at the place of use or by the machine manufacturer. They may be cut to any length and this should have no effect on the length of the screen members 3 to be arranged on them, likewise in the direction of feed in the case of a rectangular design.

Only the separation between the longitudinal support struts 2 transverse to the direction of feed F determines the width of the screen members 3 which freely span the intermediate space between two adjacent longitudinal support struts 2. The distance between two adjacent longitudinal supports 2 is equal to the edge length K of the screen members 3 in the transverse direction. In the longitudinal direction, i.e. in the direction of feed F, the screen members 3 may vary in length for adaptation to various screen deck lengths. The length of the screen members 3, however, is a function of the transverse screen member edge length K in order to have a suitable spacing for laying the entire screen deck in the case of a predetermined distance between the adjacent longitudinal support struts 2.

The longitudinal supports 2 are assembled with the screen members 3 to form the screen deck according to the invention. Fastening holes 7 on the upper sides of the longitudinal support struts 2, into which holes projections 6 (FIGS. 5*b* and 6*b*) on the undersides of the screen members 3 are inserted, to fasten the screen members 3 to the struts. The distance between the fastening holes 7 along the longitudinal supports 2 is constant and has a spacing T. The spacing T is advantageously equal to half the transverse screening member edge length K.

The projections 6 on the underside of the screen members 3 are so designed that the adjacent projections 6 (FIG. 5*a*) of screen members 3 which abut each other's longitudinal edges complement one another in pairs and together engage in one of the fastening holes 7 in each case. The projections 6 are therefore arranged directly on the undersides of the longitudinal edges 4 of the screen members 3 which abut one another directly in the area of their longitudinal edges 4, viewed transversely to the direction of feed F, in order to form the continuous screen surface. The characteristic feature of the arrangement of the projections 6 on the undersides of the screen members 3 is that they are to be found only on the longitudinal edges 4. The projection 6 are not provided on the transverse end faces 5 of the screen members 3 because the screen members are not supported in the transverse direction. Consequently, in the transverse direction projections 6 are not needed on the undersides of the screen members 3 for fastening the members to the substructure.

The longitudinal support struts 2 form a rigid substructure for the screen members 3 that consist of a flexible material. The screen members 3 are advantageously cast from synthetic material, the projections 6 being integrally formed with the members on the undersides thereof. The longitudinal supports 2 which are preferably made of steel, are connected via base plates 8 to the transverse members 1 of the screening machine which, as will be explained in more detail below, are welded or otherwise connected to the longitudinal supports 2.

Figure 2:
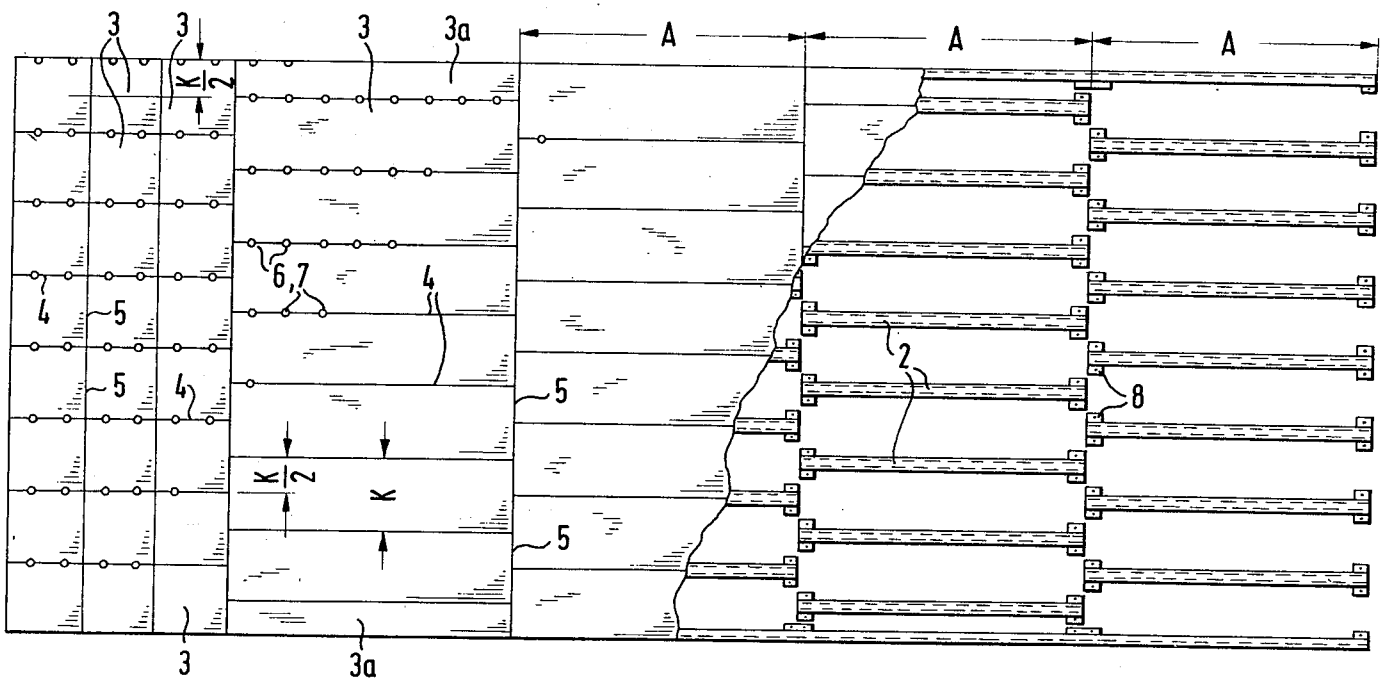
FIG. 2 is a plan view of a further arrangement of a screen deck according to the invention.

While FIG. 1 illustrates the construction of the screen deck from screen members 3 having three times the edge length K and four times the edge length K, FIG. 2 shows a screen deck in which square screen members 3 are used which have an edge length K in the direction of feed. In addition, FIG. 2 shows that the screen deck, and thus the arrangement of the longitudinal support struts 2, can be subdivided into sections A along the direction of feed F. The sections A are each staggered with respect to one another by less than the edge length, and preferably by half of the edge length K. The support areas of the screen members 3 which are already considerably reduced relative to the active screen surface (due to the omission of transverse struts), are dead zones for sorting material to be screened because material slides along these dead zones in the direction of feed F.

The staggering of the screen deck sections A transversely to the direction of feed F, however, prevents these zones running into one another in alignment over the length of the entire screen deck. Because in the illustrative embodiment shown, adjacent screen deck sections A are staggered by the half edge length K/2, screen members 3*a* of half the width, i.e. the half edge length K/2, are needed in the case of one of the sections A that adjoin one another directly. These "half" screen members 3A are just as long in the direction of feed F as the adjacent, whole screen members 3. The projections 6 also are arranged only on the longitudinal sides of the "half" screen members 3*a* because there is no transverse support for these members, either.

The length of the screen deck sections A depends on the distances between the transverse members 1 of the particular screening machine. In the case of the staggered design, too, the production and mounting of the individual longitudinal supports struts 2 as the substructure of the screen deck can be accomplished at the place where they are to be used.

FIGS. 3, 3*a* and 3*b* show a longitudinal support 2 of this type in detail. It consists of a channel that is placed upside down so that the channel web 9 is uppermost.

The fastening holes 7 are arranged as through-holes in the channel web 9. The flanges 10 are connected by means of welding seams 11 to the base plates 8 that are arranged at both ends of the longitudinal support strut 2 so that they overlap in the transverse direction. In the area of overlap the base plates 8 of the longitudinal supports 2 are fastened to the transverse members 1 of the screening machine by bolt connections 12 which are not shown in detail (FIG. 1*a* ) and for this purpose the base plates 8 have holes 13 which can be seen in the plan view of FIG. 3. Irrespective of the length of the longitudinal support strut 2, the spacing T for the distance between the fastening holes 7 is always the same, the number of fastening holes 7 per longitudinal support strut 2 being of no importance because the longitudinal support struts 2 always have more than two fastening holes 7. In the case of an odd number of fastening holes 7 per longitudinal support strut 2, the longitudinal support struts 2 can be suitably covered by means of screen members 3, the length of which is an odd multiple of 0.5 times the edge length K.

According to the embodiment of FIGS. 4 and 4*a* the longitudinal support struts 2 designed as channels may also each be arranged between two bars 14 on the base plates 8. A particularly easy alignment of the screen deck is thus achieved. The base plates 8 with the bars 14, connected, for example by means of welding seams 15, are prefabricated so that they can then be placed first of all on the transverse members 1 (FIG. 1*a*) of the screening machine. The longitudinal supports 2 are then inserted from above between the bars 14 of the base plates 8 and adjusted to the desired heights of the screen deck. Afterwards, the longitudinal supports 2 are connected to the base plates 8 by means of welding seams 16 on the upper edges of the bars 14. This substructure makes it possible to use a screen deck according to the invention even for screening machines, the transverse members 1 of which were first arranged, for example, for a central cambering of the screen deck, as is generally the case when using tension screen frames.

FIGS. 5 to 8 illustrate screen members 3 of different lengths and widths but the basic structure of which is the same. The effective screen surface of the screen members 3 is formed preferably by screen zones 17 that are separated from one another by intermediate bars 18. On the longitudinal sides, at least, the screen members 3 have edge bars 19 in the area of which the projections 6 are arranged on the undersides. In the embodiment shown the projections 6 on the undersides consist of half-tubes which extend to the upper side of the screen members 3 in half-holes 20. These parts complement one another, in the case of adjacent screen members 3 that are in contact with one another, to form complete tubes and complete holes into which fastening pins (not shown) are inserted. However, the projections 6 on the undersides may be solid instead and may optionally be a flat rectangle in cross section.

In the basic square shape with the edge length K on all sides, the screen members 3 have on their longitudinal edges 19 two projections 6 that are arranged symmetrically with respect to the transverse centre. FIG. 5 shows such a design; the screen member 3*a* according to FIG. 7 differs from this embodiment only in having a width of the half edge length K/2 which it needs, being a compensating member for the transversely staggered screen deck sections A that are shown in FIG. 2. FIG. 6 illustrates a screen member 3 that has a double longitudinal edge length 2K in the direction of feed four projections 6 are disposed on the undersides of each of the two longitudinal edges 4. Analogously to this there is a design with the half width K/2 likewise as a compensating member 3*a*, and this is shown in FIG. 8. The front views in FIGS. 5*a* and 7*a* apply in like manner to the embodiments of the screen members which are shown in FIGS. 6 and 8, respectively. The side views according to FIGS. 5*b* and 6*b* in like manner correspond to the embodiment of the screen members that are shown in FIGS. 7 and 8, respectively.

FIG. 9 illustrates a number of possible choices for the length of the screen members 3. In principle, all screen members 3 have the transverse edge length K in a direction that is perpendicular to the direction of feed F. In the case of the square design already mentioned this is, of course, also the longitudinal length of the screen member in the direction of feed. The rectangular screen members 3 are so extended in stages from this square starting shape, until, for example, a quadruple longitudinal edge length 4K is formed for each of the screen members having the next increment of length there always is an extra projection 6 on the underside of each longitudinal edge, spaced a distance equal to the spacing T from the nearest adjacent projection. Because the spacing T of the projections 6 on the undersides of the screen members is equal to the half edge length K/2 of the square starting shape, the lengths of the rectangular screen members are 1.5 times or a greater integral multiple of 0.5 times the edge length K. Practically all screen deck lengths that occur can be covered using a constructions unit of this type having screen members of various lengths. Advantageously, the projection 6 on the undersides of the screen members 3 are always arranged at the same level on the two longitudinal edges 4 in relation to the direction of feed, the two projections 6 near the transverse end faces 5 in each case leaving a distance of the half spacing T/2 from the transverse sides of the screen members 3.

FIG. 10 shows a further characteristic feature of the screen members 3 of the screen deck according to the invention. One or more grooves 21 are made in the end faces 5 of the screen members 3. These grooves 21, each extend over the whole transverse width of the screen members 3 and are always positioned at the same level. In the case of screen members 3 that abut one another at their end faces 5 the grooves 21 complement one another to form through-holes into which rods 23, the contours of which are matched to these holes, can be inserted, for example from the longitudinal sides of the members. The screen members 3 are thus completely sealed at their end faces 5 where they are not connected to one another by means of projections on their undersides and supports positioned below these.

In extreme cases, therefore, the width of the gap at the butt joint between the transverse end faces 5 of the screen members 3 may be greater than the width of the gap provided for the effective screen surface. In this situation, material to be screened that has an undesirable particle size could pass through the gaps at the butt joints. This is prevented, however, by the rods 23 that are inserted in a positive-locking manner into the grooves 21 that complement one another. These rods 23 advantageously consist of a synthetic material such as polyurethane. The edges 19 (FIGS. 5 to 8) of the screen members 3 also advantageously consist of the same material and in contrast to this, the effective screen zones 17 may consist of a softer flexible material. The strengthening of the edges 19 of the screen members 3 by a steel reinforcement 22 can also be seen in FIG. 10.

The reinforcement 22 has the task of ensuring that the edge bars 19 in the longitudinal direction, particularly in the case of long screen members 3, maintain dimensional stability with respect to the spacing T and the overall dimensions. The reinforcement 22 in the transverse direction also absorbs the bending forces in the screen members 3 themselves which occur because there are no transverse struts.

The embodiments of the invention in which an exclusive property or privilege is claimed are defined as follows:

1. A screen deck having rigid support struts each having fastening holes formed therein and a plurality of rectangular flexible screen members having longitudinal and transverse edges arranged thereon the screen members abutting one another directly in order to form a continuous screen, said longitudinal edges being parallel with said support struts, the distances between adjacent pairs of the support struts being equal to the length of the transverse edge of one of the screen members, the screen members having each a surface positioned next to said rigid support struts and having at the screen member edges which complement one another in pairs at the point of abutment of adjacent screen members the projections protruding from said surface that is next to said rigid support struts and together engage in one fastening hole in each complementing pair on the sides of the support struts, adjacent to the screen member surfaces wherein the invention comprises the lengths of at least some of the longitudinal edges of the screen members being at least one and a half times the transverse screen member edge, the longitudinal support struts and rows of screen members being subdivided into abutting sections, the successive abutting sections being staggered in the transverse direction relative to each other by a distance less than the transverse screen member edge length.

2. A screen deck according to claim 1, wherein the invention further comprises at least some of the screen members being compensating screen members having transverse edge lengths reduced in width to match the transverse staggering and positioned on the edge of the particular staggered sections.

* * * * *